US006540943B1

(12) United States Patent
Treybig et al.

(10) Patent No.: US 6,540,943 B1
(45) Date of Patent: Apr. 1, 2003

(54) METHOD OF INHIBITING CORROSION OF METAL EQUIPMENT WHICH IS CLEANED WITH AN INORGANIC ACID

(75) Inventors: Duane S. Treybig, Sugar Land, TX (US); Dennis A. Williams, Houston, TX (US)

(73) Assignee: Ondeo Nadco Company, Naperville, IL (US)

( * ) Notice: Subject to any disclaimer, the term of this patent is extended or adjusted under 35 U.S.C. 154(b) by 0 days.

(21) Appl. No.: 09/541,775

(22) Filed: Apr. 3, 2000

(51) Int. Cl.[7] ..... C23F 11/04

(52) U.S. Cl. ..... 252/391; 252/392; 252/402; 252/403; 510/253; 510/255; 510/401; 106/14.16; 106/14.42; 422/7; 422/12; 507/240; 507/252; 507/939

(58) Field of Search ..... 252/390, 391, 252/392, 394, 395, 401, 402, 405, 406; 510/401, 253, 255; 106/14.16, 14.42, 14.43; 422/7, 12; 507/240, 252, 939

(56) References Cited

U.S. PATENT DOCUMENTS

| | | | | |
|---|---|---|---|---|
| 3,197,403 A | | 7/1965 | Riggs, Jr. | |
| 3,887,488 A | | 6/1975 | Scott et al. | |
| 4,498,997 A | | 2/1985 | Walker | |
| 4,637,899 A | | 1/1987 | Kennedy, Jr. | |
| 5,130,034 A | | 7/1992 | Williams et al. | |
| 5,314,626 A | | 5/1994 | Dimas | |
| 5,366,643 A | * | 11/1994 | Walker | |
| 5,415,782 A | | 5/1995 | Dimas | |
| 5,492,629 A | * | 2/1996 | Ludwig et al. | 210/698 |
| 5,614,028 A | | 3/1997 | Rodzewich | |
| 5,763,368 A | * | 6/1998 | Brezinski | 507/240 |
| 5,853,619 A | | 12/1998 | Watson et al. | |
| 5,976,416 A | | 11/1999 | Brezinski | |
| 6,118,000 A | | 9/2000 | Frenier | |

FOREIGN PATENT DOCUMENTS

| | | |
|---|---|---|
| EP | 0086245 | 8/1983 |

* cited by examiner

*Primary Examiner*—Joseph D. Anthony
(74) *Attorney, Agent, or Firm*—Kelly L. Cummings; Thomas M. Breininger

(57) ABSTRACT

The corrosion of metal equipment which is cleaned with an inorganic acid is inhibited by treating the equipment with a corrosion inhibitor composition containing at least one quaternary ammonium compound, a sulfur-containing compound and a nonionic surfactant in a solvent.

17 Claims, No Drawings

METHOD OF INHIBITING CORROSION OF METAL EQUIPMENT WHICH IS CLEANED WITH AN INORGANIC ACID

FIELD OF THE INVENTION

This invention relates generally to corrosion inhibition and, more particularly, to a method of inhibiting corrosion of metal equipment which is cleaned with an inorganic acid.

BACKGROUND OF THE INVENTION

Acidic cleaning solutions are commonly employed to remove scale and rust from industrial equipment. However, acid is corrosive to the metal components of the equipment. Therefore, the cleaning solutions usually contain corrosion inhibitors to minimize the corrosive effect that the acid has on the equipment.

Cleaning solutions comprising an organic acid and a corrosion inhibitor are generally known (See, e.g., U.S. Pat. No. 4,637,899). However, because inorganic acids are more difficult to work with, protecting metal equipment which is cleaned with an inorganic acid from corrosion has been less successful.

There is a particular need for an effective inorganic acid corrosion inhibitor in mineral processing operations, such as the production or beneficiation of alumina trihydrate (also known as aluminum hydroxide, alumina and gibbsite), copper, gold and other metals. For example, in the production of alumina, bauxite is digested with a hot caustic soda solution. This results in the dissolution (digestion) of a considerable portion of the aluminum-bearing minerals, giving a supersaturated solution of sodium aluminate (pregnant liquor). After the physical separation of undigested mineral residues (red mud), the sodium aluminate solution is decomposed to afford alumina trihydrate, which is recovered by filtration. During the digestion of bauxite ore, the attack of caustic soda on certain silica-bearing components in the ore results in the release of soluble silica species into the liquor. These soluble silicates then react with alumina and soda to form insoluble sodium aluminosilicates which are also known as desilication products, or DSP. The desilication product is deposited as scale on the walls of pipes and vessels throughout the plant. Scaling by DSP is particularly severe on heated equipment surfaces, such as heat exchanger tubes. The exchanger tubes and other equipment are cleaned with an inorganic acid, usually sulfuric acid. Therefore, a corrosion inhibitor is necessary to protect the alumina refinery utility equipment from corrosion while the sulfuric acid is being recirculated during the cleaning process.

Accordingly, it would be desirable to provide an improved method for inhibiting the corrosion of metal equipment which is cleaned with an inorganic acid using an effective amount of a corrosion inhibitor composition. It would also be desirable for the composition to minimize the corrosive effect that the inorganic acid has on the metal equipment, while withstanding the harsh acidic environment, particularly in mineral processing operations where sulfuric acid is regularly used in the cleaning process.

SUMMARY OF THE INVENTION

The present invention calls for treating metal equipment which is cleaned with an inorganic acid with a corrosion inhibitor composition containing at least one quaternary ammonium compound, a sulfur-containing compound and a nonionic surfactant in a solvent. Treatment with the composition effectively inhibits the corrosion of the metal equipment.

DETAILED DESCRIPTION OF THE INVENTION

The present invention is directed to a method of inhibiting corrosion of metal equipment which is cleaned with an inorganic acid. In accordance with this invention, a corrosion inhibitor composition comprising at least one quaternary ammonium compound, a sulfur-containing compound and a non-ionic surfactant in a solvent is used to treat the equipment to minimize the corrosive effect that the inorganic acid has on the equipment.

All types of industrial equipment which are commonly exposed to high concentrations of inorganic acids, such as mineral processing equipment, are contemplated within the scope of this invention, including pipes, vessels, heat exchanger tubes and holding tanks. The equipment, which is typically composed of metals such as iron, copper, copper alloys, zinc, zinc alloys, nickel, nickel alloys, stainless steel and the like, is most commonly cleaned with sulfuric acid. However, other suitable inorganic acids which may be used to clean the equipment include nitric, phosphoric, hydrochloric and phosphonic.

The quaternary ammonium compounds which may be used in the corrosion inhibitor composition in the practice of the invention are represented by the general formula:

$$(R)_4N^{+X-}$$

wherein each R is the same or a different group selected from long chain alkyl groups, cycloalkyl groups, aryl groups and heterocyclic groups, and $X^-$ is an anion such as a halide. The term "long chain" is used herein to mean hydrocarbon groups having in the range of from about 12 to about 20 carbon atoms.

Examples of suitable quaternary ammonium compounds which can be used in the corrosion inhibitor include N-alkyl, N-cycloalkyl and N-alkylaryl pyridinium halides such as N-cyclohexyl-pyridinium bromide, N-octylpyridinium bromide, N-nonylpyridinium bromide, N-decylpyridinium bromide, N-dodecyl-pyridinium bromide, N,N-didodecyldipyridinium dibromide, N-tetradecylpyridinium bromide, N-laurylpyridinium chloride, N-dodecylbenzylpyridinium chloride, N-dodecylquinolinium bromide, N-(1-methylnapthyl) quinolinium chloride, N-benzylquinolinium chloride and mixtures thereof. Other suitable quaternary ammonium compounds include monochloromethylated and bizchloromethylated pyridinium halides, ethoxylated and propoxylated quaternary ammonium compounds, sulfated ethoxylates of alkyphenols and primary and secondary fatty alcohols, didodecyldimethylammonium chloride, hexadecylethyldimethylammonium chloride, 2-hydroxy-3-(2-undecylamidoethylamino)-propane-1-triethylammonium hydroxide, 2-hydroxy-3-(2-heptadecylamidoethylamino)-propane-1-triethylammonium hydroxide and mixtures thereof. The preferred quaternary ammonium compound is alkylpyridine benzyl chloride quaternary.

The amount of the quaternary ammonium compound present in the corrosion inhibitor composition is in the range of about 30 to about 60 weight percent and, preferably, in the range of about 40 to about 50 weight percent.

The sulfur-containing compounds which may be used in the corrosion inhibitor composition include mercapto compounds, thiourea, thioacetamide, thionicotinamide ammonium thiocyanate and mixtures thereof. Preferably, mercapto compounds are used in the practice of this invention. Suitable mercapto compounds include 2-mercaptoethanol, thiol acetic acid, mercaptocarboxylic acid having from 2 to 6 carbon atoms (straight chain or branched), mercapto succinic acid, toluene thiol and orthomercapto benzoic acid. The most preferred mercapto compound is 2-mercaptoethanol.

The amount of sulfur-containing compound present in the corrosion inhibitor composition is in the range of about 1 to 20 weight percent and, preferably, in the range of about 2 to about 10 weight percent.

In order to facilitate the wetting of the metal surface, a wetting agent is employed. Such wetting agents are nonionic surfactants. Useful nonionic surfactants are alkoxylated alcohols, amines and glycols. These nonionic surfactants include ethylene oxide derivatives of long-chain alcohols such as octyl, decyl, lauryl or cetyl alcohol, ethylene oxide derivatives of long-chain monoamines such as octyl, decyl, lauryl, oleyl or tallow amine and long chain diamines. The diamines correspond to the following general formula:

$$(C_nH_{2n+1})—NH—(CH_2)_2—NH—R$$

wherein n represents an integer from about 12 to 18 and R is an alkoxide group. Alkoxylated alcohols are the preferred nonionic surfactants, especially alkoxylated tridecyl alcohol.

The amount of the nonionic surfactant present in the corrosion inhibitor composition is in the range of about 5 to about 20 weight percent and, preferably, in the range of about 10 to about 15 weight percent.

The corrosion inhibitor composition may be in the form of a solution or in the form of dispersion in either water or an organic solvent. Suitable organic solvents include alcohols such as methanol, ethanol, isopropanol, isobutanol, secondary butanol, gycols and aliphatic or aromatic hydrocarbons. Isopropanol is the preferred solvent.

The amount of solvent present in the corrosion inhibitor composition is in the range of about 0 to about 30 weight percent and, preferably, in the range of about 20 to bout 30 weight percent.

The corrosion inhibitor composition is used at a concentration which will effectively inhibit corrosion of metal equipment which is cleaned with an inorganic acid. Is it preferred that the amount of the corrosion inhibitor composition be in the range of about 0.008 weight % to about 3 weight % based on the weight (grams) of the inorganic acid. More preferably, the amount of the corrosion inhibitor composition is from about 0.04 weight % to about 0.5 weight %.

The metal equipment may be cleaned by any conventional method. For instance, mineral processing equipment is cleaned with acid, and typically an acid solution which is 80 to 100 g/L of sulfuric acid. The sulfuric acid is prepared in a batch tank using neat acid and industrial water. Once the acid solution is ready, the corrosion inhibitor is added to the tank with a positive displacement pump, any other pump or manually. The tank is recirculated for 15 minutes. Finally, an antifoam is added to avoid foaming, overflow of foam from the tank and possible pump cavitation. The valve of the system is opened and the solution recirculates throughout the whole system to be cleaned. It leaves the batch tank, goes through the pipe and tubes and returns to the batch tank. This operation typically consumes about 2 hours. Batch or static treatment may also be used to remove the scale. To control the cleaning time, samples of the acid are taken every 30 minutes and its strength is measured. When the strength (g/L) starts to be constant, the cleaning is interrupted. This generally happens around 70 g/L of acid in the solution. The temperature of this process is usually kept under 60° C. to avoid corrosion, although higher temperatures can be used.

Before the acid cleaning, neutralization water is circulated to wash the soda (spent liquor) and this water is stored in the tank. After the acid cleaning, the same "neutralization water" is recirculated again, to wash the acid in the pipes.

The present inventors have surprisingly discovered that the corrosive effect which inorganic acid has on metal equipment can be minimized by treating the equipment with a corrosion inhibitor composition comprising at least one quaternary ammonium compound such as alkylpyridine benzyl chloride quaternary, a sulfur-containing compound such as 2-mercaptoethanol, and a nonionic surfactant in a solvent such as alkoxylated tridecyl alcohol in isopropanol. The composition has been found to protect the equipment from corrosion, while withstanding the harsh acidic environment.

Furthermore, the composition has been found to provide better protection against corrosion than current commercial inhibitors. Although the composition may be effectively used on essentially any type of industrial equipment, it has been found to be particularly useful in mineral processing operations, especially to protect the alumina refinery utility equipment from corrosion while sulfuric acid is recirculated during the cleaning process.

EXAMPLES

The following examples are intended to be illustrative of the present invention and to teach one of ordinary skill how to make and use the invention. These examples are not intended to limit the invention or its protection in any way.

Example 1

A corrosion inhibitor was prepared by blending 90.64 grams of alkoxylated tridecyl alcohol, 300 grams of alkylpyridine benzyl chloride quaternary and 60.11 grams of 2-mercaptoethanol in 150 grams of isopropanol.

Example 2

300 mls of 100 g/L sulfuric acid was poured into glass bottles. A known amount grams) of the corrosion inhibitor from Example I was measured and added to the bottles. The solution was mixed well and stainless steel (SS) 1010 or A179 coupons were placed in the bottles. The bottles were placed in a water bath at 60° C. and atmospheric pressure (open air) for 24 hours. The coupons were pre-weighed. The initial pre-weighed value was recorded as (A) in mg. After the test, the coupons were washed with tap water, then with alcohol or acetone and allowed to dry for 30 minutes in the oven. The coupons were then allowed to cool in a desicator and weighed. This number was recorded as (B) in mg. The MPY was calculated as:

$$MPY=[(A-B)\times F]/C$$

where: F=Area Factor (The coupons in this Example had an area factor of 1.11) and C=Days of exposition (hours were converted to days).

Betz Dearborn's M 23 B corrosion inhibitor is commonly used for protection against corrosion in sulfuric acid. It limits the corrosion of stainless steel (SS) 1010 to about 50 MPY at concentrations of M 23 B greater than 1000 ppm. The corrosion inhibitor from Example 1 provides much better protection of SS 1010 against corrosion than M 23 B at concentrations of inhibitor less than 1000 ppm as can be seen from the tables below.

TABLE 1

| SS 1010 Coupons | | | | | |
|---|---|---|---|---|---|
| Example 1 Inhibitor | | | M 23B Inhibitor | | |
| Dosage (ppm) | Dosage (%) | Corrosion (MPY) | Dosage (ppm) | Dosage (%) | Corrosion (MPY) |
| 516 | 0.052 | 142.1 | 500 | 0.050 | 357.4 |
| 998 | 0.100 | 56.1 | 1008 | 0.101 | 50.0 |
| 1496 | 0.150 | 45.5 | 1526 | 0.153 | 34.4 |

TABLE 2

| SS 1010 Coupons | | | | | |
|---|---|---|---|---|---|
| Example 1 Inhibitor | | | M 23B Inhibitor | | |
| Dosage (ppm) | Dosage (%) | Corrosion (MPY) | Dosage (ppm) | Dosage (%) | Corrosion (MPY) |
| 499.4 | 0.050 | 137.1 | 520.6 | 0.0520 | 703.2 |
| 1013.8 | 0.101 | 53.3 | 984.0 | 0.0980 | 298.1 |
| 1498.6 | 0.150 | 43.3 | 1502.4 | 0.150 | 71.0 |

TABLE 3

| SS 1010 Coupons M 23B Inhibitor | | |
|---|---|---|
| Dosage (ppm) | Dosage (%) | Corrosion (MPY) |
| 531 | 0.053 | 866.9 |
| 1036 | 0.104 | 117.0 |
| 1616 | 0.162 | 64.3 |

As shown below in Table 4, M 23 B limits corrosion of A179 (seamless carbon steel) to about 126 MPY at concentrations of M 23 B greater than 1500 ppm. The corrosion inhibitor from Example 1 limits corrosion of A179 to about 70 MPY at concentrations equal to and greater than 500 ppm. Thus, the corrosion inhibitor from Example 1 would be the preferred corrosion inhibitor for protecting A179.

TABLE 4

| A179 Coupons | | | | | |
|---|---|---|---|---|---|
| Example 1 Inhibitor | | | M 23B Inhibitor | | |
| Dosage (ppm) | Dosage (%) | Corrosion (MPY) | Dosage (ppm) | Dosage (%) | Corrosion (MPY) |
| 499.4 | 0.050 | 59.1 | 520.6 | 0.0520 | 4590 |
| 1013.8 | 0.101 | 67.1 | 984.0 | 0.0980 | 623.3 |
| 1498.6 | 0.150 | 49.7 | 1502.4 | 0.150 | 125.5 |

Example 3

A known volume of the corrosion inhibitor from Example 1 was added to 4 ounce wide mouth glass bottles using a micropipette. 10% (100 g/L) sulfuric acid was then poured into the glass bottles to give a total volume of 100 mls. The solution was mixed well and pre-weighed. 1010 coupons (1 inch by 3 inches by 1/16 inches) were placed in the bottles and stirred for 10 seconds. The coupons were placed in the bottles with the concave surface facing down. About a 1.5 inch layer of thermally stable oil (Teresstic 32) was added to the bottles. Caps were placed on the bottles loosely. The bottles were then placed in a circulated water bath at 140° F. (60° C.) and atmospheric pressure (open air) for 24 hours. After the test, the coupons were washed with tap water, scrubbed with a wire brush and thoroughly washed with acetone and dried. The coupons were then weighed. The MPY was calculated according to the formula in Example 2.

As shown below in Table 5, the corrosion inhibitor from Example 1 limits corrosion of SS 1010 to about 60 MPY or less at concentrations from 500 to 4000 ppm inhibitor in 7 and 13 wt % sulfuric acid for 24 hours at 140° F. (60° C.).

TABLE 5

| Temp. ° F. | Acid | Acid Wt. % | Time Hours | Example 1 ppm | Coupon | C Rate MPY | Type Corr. | Pitting Index |
|---|---|---|---|---|---|---|---|---|
| 140 | H2SO4 | 7.0 | 24 | 500 | ASTM 1010 | 52.8 | General | 0 |
| 140 | H2SO4 | 7.0 | 24 | 1,000 | ASTM 1010 | 38.0 | General | 0 |
| 140 | H2SO4 | 7.0 | 24 | 2,000 | ASTM 1010 | 25.0 | General | 0 |
| 140 | H2SO4 | 13.0 | 24 | 1,000 | ASTM 1010 | 62.9 | General | 0 |
| 140 | H2SO4 | 13.0 | 24 | 2,000 | ASTM 1010 | 62.4 | General | 0 |
| 140 | H2SO4 | 13.0 | 24 | 4,000 | ASTM 1010 | 49.2 | General | 0 |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of inhibiting corrosion of metal equipment which is cleaned with an inorganic acid comprising the step of treating the equipment with an effective amount of a corrosion inhibitor composition admixed with the inorganic acid, the corrosion inhibitor composition comprising:

a. at least one quaternary ammonium compound, b. a sulfur-containing compound and c. a nonionic surfactant in a solvent wherein the corrosion inhibitor composition comprises from about 40 to about 50 weight percent of the quaternary ammonium compound, from about 2 to about 10 weight percent of the sulfur-containing compound, from about 10 to about 15 weight percent of the nonionic surfactant and from about 20 to about 30 weight percent of the solvent.

2. The method of claim 1 wherein the inorganic acid is selected from the group consisting of sulfuric, nitric, phosphoric, hydrochloric and phosphonic acids.

3. The method of claim 1 wherein the quaternary ammonium compound is represented by the general formula:

$$(R)_4N^+X^-$$

wherein each R is individually selected from the group consisting of long chain alkyl groups, cycloalkyl groups, aryl groups and heterocyclic groups, and $X^-$ is an anion.

4. The method of claim 1 wherein the quaternary ammonium compound comprises an alkylpyridine benzyl chloride quaternary salt.

5. The method of claim 1 wherein the solvent is isopropanol.

6. The method of claim 1 wherein the equipment is treated with the corrosion inhibitor composition in an amount of from about 0.008 to about 3 weight percent based on the weight of the inorganic acid.

7. The method of claim 1 wherein the equipment is treated with the corrosion inhibitor composition in an amount of from about 0.04 to about 0.5 weight percent based on the weight of the inorganic acid.

8. The method of claim 1 wherein the metal equipment is selected from the group consisting of pipes, vessels, heat exchanger tubes and holding tanks.

9. The method of claim 1 wherein the sulfur-containing compound is selected from the group consisting of mercapto compounds, thiourea, thioacetamide, thionicotinamide, ammonium thiocyanate and mixtures thereof.

10. The method of claim 9 wherein the sulfur-containing compound is 2-mercaptoethanol.

11. The method of claim 1 wherein the nonionic surfactant is selected from the group consisting of alkoxylated alcohols, amines and glycols.

12. The method of claim 7 wherein the nonionic surfactant is alkoxylated tridecyl alcohol.

13. A method of inhibiting corrosion of metal equipment which is cleaned with an inorganic acid comprising the step of treating the equipment with an effective amount of a corrosion inhibitor composition admixed with the inorganic acid, the corrosion inhibitor composition comprising an alkylpyridine benzyl chloride quaternary salt, 2-mercaptoethanol and alkoxylated tridecyl alcohol in isopropanol wherein the corrosion inhibitor composition comprises from about 40 to about 50 weight percent of an alkylpyridine benzyl chloride quaternary salt, from about 2 to about 10 weight percent of 2-mercaptoethanol, from about 10 to about 15 weight percent of alkoxylated tridecyl alcohol and from about 20 to about 30 weight percent of isopropanol.

14. The method of claim 13 wherein the inorganic acid is selected from the group consisting of sulfuric, nitric, phosphoric, hydrochloric and phosphonic acids.

15. The method of claim 13 wherein the equipment is treated with the corrosion inhibitor composition in an amount of from about 0.008 to about 3 weight percent based on the weight of the inorganic acid.

16. The method of claim 13 wherein the equipment is treated with the corrosion inhibitor composition in an amount of from about 0.04 to about 0.5 weight percent based on the weight of the inorganic acid.

17. The method of claim 13 wherein the metal equipment is selected from the group consisting of pipes, vessels, heat exchanger tubes and holding tanks.

* * * * *